US005145338A

United States Patent [19]

Murray

[11] Patent Number: 5,145,338

[45] Date of Patent: Sep. 8, 1992

[54] LOW PRESSURE FLUID PUMP

[76] Inventor: Robert H. Murray, 52 Manor Hill Dr., Fairport, N.Y. 14450

[21] Appl. No.: 626,183

[22] Filed: Dec. 12, 1990

[51] Int. Cl.[5] ..... F04B 43/00

[52] U.S. Cl. ..... 417/480; 417/903; 92/92; 92/130 R

[58] Field of Search ..... 417/437, 472, 480, 903, 417/394; 92/92, 130 R

[56] References Cited

U.S. PATENT DOCUMENTS

| | | | |
|---|---|---|---|
| 888,833 | 5/1908 | Miller | 417/540 |
| 2,943,641 | 7/1960 | Arnold | 417/540 |
| 3,133,696 | 5/1964 | Mirando | 417/480 |
| 3,155,991 | 11/1964 | Dunham | 417/480 |
| 3,524,714 | 8/1970 | Grove et al. | 417/540 |
| 3,561,892 | 2/1971 | Ackermann et al. | 417/437 |
| 3,804,125 | 4/1974 | Sonneman | 417/540 |
| 4,906,167 | 3/1990 | Besic et al. | 417/437 |

*Primary Examiner*—Richard A. Bertsch
*Assistant Examiner*—Charles G. Freay
*Attorney, Agent, or Firm*—Robert J. Bird

[57] ABSTRACT

A low pressure air pump includes an outer flexible envelope which encloses an articulate frame. When the envelope is manually compressed against a smooth surface, an intake aperture on the bottom side of the envelope is sealed and air is forced out of the pump. When pressure is released from the pump, the frame returns the envelope to its uncompressed state and, in so doing, opens the intake aperture to take in more air.

11 Claims, 6 Drawing Sheets

LOW PRESSURE FLUID PUMP

FIELD OF THE INVENTION

A low-pressure fluid pump, useful for inflating toy balloons, which may be manually operated by compression With one's hand or foot.

BACKGROUND OF THE INVENTION

Pneumatic devices which may be manually operated by compression by a person's hand or foot are well known to those skilled in the art.

In 1909, in his U.S. Pat. No. 926,315, Fritz Beck disclosed a pneumatic device comprised of a compressible ball mounted in a holder provided with two air passages; when air was to be forced out of the device, the operator had to place a finger over one of the air passages while compressing the ball with his thumb. Beck's device presented several problems. In the first place, it required a substantial degree of manual dexterity for the operator to simultaneously seal the intake air passage and compress the ball with his thumb. In the second place, it required a relatively large amount of force (and strength) to deliver a relatively small amount of air from the device In the third place, the device was relatively bulky and could not be compressed so that it would take up a relatively small amount of storage space.

The problem of providing an inflation device which would deliver a reasonable quantity of air at moderate pressure had not been solved by 1929. In his U.S. Pat. No. 1,787,153, William H. Huffman described a device which was capable of delivering large quantities of air at low pressure for the purpose of inflating air mattresses, pneumatic boats, and similar devices. In column 1 of his patent, Huffman disclosed that the prior art devices required ". . . a great amount of manual labor and exertion . . ." and were ". . . slow in process .. ." and ". . . cumbersome to handle . . ." Huffman's solution was to provide a refillable, pliable container with one open end which was designed to be ". . . held at arm's length to the wind . . ." and operated with ". . . a quick scooping action . . ." to fill it with air. Once Huffman's device had been filled with air, the open end was sealed and then rolled up in order to discharge the air. There are several disadvantages to Huffman's approach. In the first place, his device is cumbersome to use (especially in a restricted space) and difficult to discharge air from; furthermore, the rate of air discharge from the device is relatively slow.

Another inflation device which required a fair amount of manual dexterity to operate was disclosed in 1937 in Salvatore Scavo's U.S. Pat. No. 2,094,499. The life preserver described in this contained a bulb having an air inlet opening. In order to discharge air from the bulb, the operator placed a finger over the opening and compressed the bulb by squeezing. This device Was no less disadvantageous than the device disclosed in the Beck patent.

In 1952 yet another inflation device was described in U.S. Pat. No. 2,686,006 of Hasselquist. The device of this patent was comprised of a hollow body having a plurality of axially-expansible annular folds In order to operate this bellows-like structure, one first had to manually extend the bellows with both hands to draw air therein. Thereafter, the bellows was compressed to discharge the air. This device required a substantial amount of upper body strength and the use of both hands to operate.

The inflation devices provided prior to 1955 apparently were not suitable for use by children. In his 1955 patent, paul Glasco disclosed that "At the present time there is lacking a satisfactory balloon pump with which small children may quickly and easily blow up balloons and other inflatable devices." However, the device provided by Glasco was not entirely satisfactory for use by children. This device, which was comprised of a hollow body with an exhaust valve and an intake valve, required the child to place his thumb over the intake valve while squeezing the ball. In addition to requiring a fair amount of manual dexterity from the child, it also required a substantial amount of strength to deliver only a relatively low volume of air.

In 1964, Louis Mirando disclosed a foam-filled pump in his U.S. Pat. No. 3,133,696. Mirando disclosed that, prior to using his pump, ". . . the valve 27 provided on the mattress is first closed . . . ;" however, no valve 27 is shown in Mirando's figures. After the valve 27 has been manually closed, one then had to squeeze the foam material in the Mirando device by stepping on it with one's foot. It appears that, in addition to requiring the closure of an intake valve 27, the Mirando device also wasted a substantial amount of energy for the compression of the foam.

In 1967, in his U.S. Pat. No. 3,297,241, Bror Andreasson discussed the problems with the prior art inflation devices. In column 1 of his patent, Andreasson disclosed that the prior art air pumps were ". . . in the shape of bellows or a rubber bulb with a valve." These pumps, according to Andreasson, were ". . . hard to operate . . ." With these pumps, "the inflation is rather tiring and time-wasting due to the small volume which is inflated at each pump stroke." The apparatus of the Andreasson patent, however, required a fair amount of coordiation to operate. This device, which contained a large rectangular bag, a mouth piece arranged in the wall of a chamber of the bag, and a closable valve opening provided in a partition of the bag, required the operator to repeatedly fill the bag with air, manually press most of the air out of the bag, close off an intake valve on a small partition of the bag, and compress this small partition area while keeping the intake valve closed.

In 1968, in his U.S. Pat. No. 3,363,833, Asmund Stavanger disclosed an elastic plastic bag which could be folded in its axial direction to a configuration in which it took up only a fraction of its original volume. However, when the wall portions of the bag of this patent were bent beyond a dead-center position, it became necessary to apply force to return the bag to its expanded, operative position.

It is an object of this invention to provide a low pressure fluid pump which can readily be operated by a child.

It is another object of this invention to provide a low pressure fluid pump which, during its operation, does not require that any of its orifices be sealed by a finger, hand, or other body part of an operator.

It is yet another object of this invention to provide a low pressure fluid pump which, when it is not in use, can be readily compressed to a configuration in which its takes up a space which is only a small fraction of its original volume.

It is yet another object of this invention to provide a low pressure fluid pump which, when it is not in use, can be readily maintained in a compressed configuration.

It is yet another object of this invention to provide a low pressure fluid pump which can be operated with only one hand or other body part.

It is yet another object of this invention to provide a low pressure fluid pump whose operation does not require the expenditure of a substantial amount of energy in compressing a relatively high-density material It is yet another object of this invention to provide a low pressure fluid pump which, after it has been compressed to deliver fluid from its chamber, rapidly and automatically returns to its operative position.

It is yet another object of this invention to provide a low pressure fluid pump which delivers a relatively large amount of air per compression cycle.

It is yet another object of this invention to provide a low pressure fluid pump comprised of a self-sealing intake valve.

It is yet another object of this invention to provide a low pressure fluid pump with an intake valve which does not extend into the chamber of the pump.

It is yet another object of the invention to provide a low pressure fluid pump which allows the user to compress the pump with at least a major portion of his body weight.

It is yet another object of this invention to provide a low pressure fluid pump which is simple and economical to manufacture.

It is yet another object of this invention to provide an article of manufacture comprised of the low pressure fluid pump of this invention packaged with a multiplicity of balloons.

It is yet another object of this invention to provide a pump apparatus suitable for inflating receptacles requiring medium to high fluid pressure.

It is yet another object of this invention to provide a low pressure fluid pump which is relatively lightweight.

It is yet another object of this invention to provide a low pressure fluid pump at least one of whose interior surfaces provides a uniform surface on which a printed message may appear.

SUMMARY OF THE INVENTION

In accordance with this invention, there is provided a low pressure fluid pump which contains a bag comprised of a first intake orifice, a semirigid, resilient, inner structure which is disposed within said bag and is comprised of a second intake orifice, means for aligning said first intake orifice with said second intake orifice, and self-actuating means for obstructing said first intake orifice when said pump is compressed.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
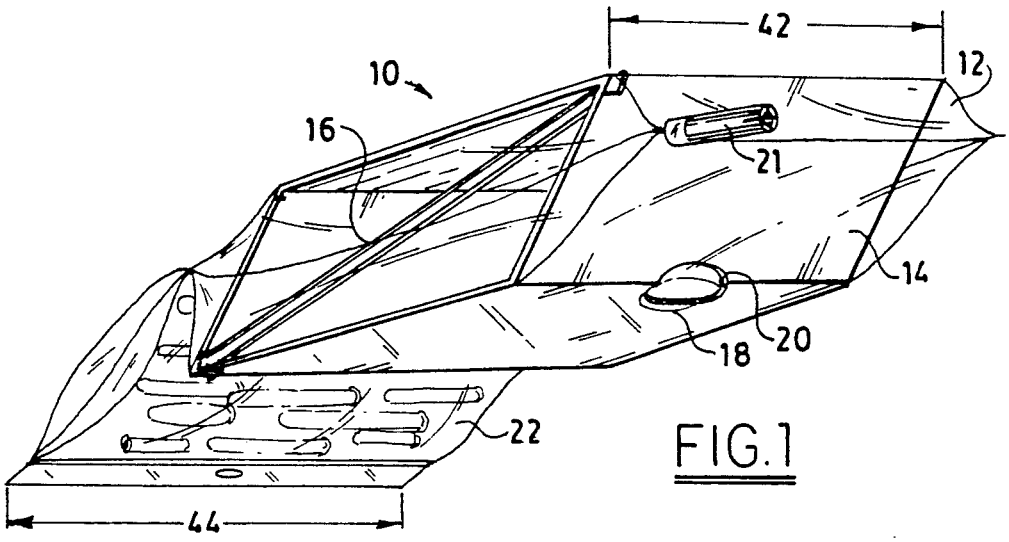
FIG. 1 is a perspective view of one preferred embodiment of the pump of this invention.

A perspective view of one preferred embodiment of applicant's invention is presented in FIG. 1. Referring to FIG. 1, pump 10 is comprised of outer flexible bag 12, inner semirigid member 14, means 16 for maintaining at least two opposing walls of said semirigid member 14 in spaced relation to each other, a first intake orifice 18 extending through a wall of said outer flexible bag 12, a second intake orifice 20 extending through a wall of said semirigid member 14, and a check valve 21. The embodiment illustrated in this Figure also contains a closed compartment of balloons 22 formed as a part of or attached to said pump 10.

Outer flexible bag 12 preferably consists of a flexible material such as, polyethylene, polyvinyl chloride, rubberized cloth, or the like.

In one preferred embodiment, bag 12 consists essentially of a polyethylene with a density of from about 0.910 to about 0.959 and, preferably, from about 0.910 to about 0.925.

The material comprising bag 12 should be flexible. Thus, it is preferred that the thickness of such bag be from about 1 to about 4 mils and, more preferably, from about 1.5 to about 2.75 mils.

The bag 12 contains at least two walls defining a closed structure with two orifices. One of such orifices, the intake orifice 18, communicates with intake orifice 20 of semirigid member 14 The other of said orifices, an output orifice (not shown), communicates with check valve 21.

Figure 2:
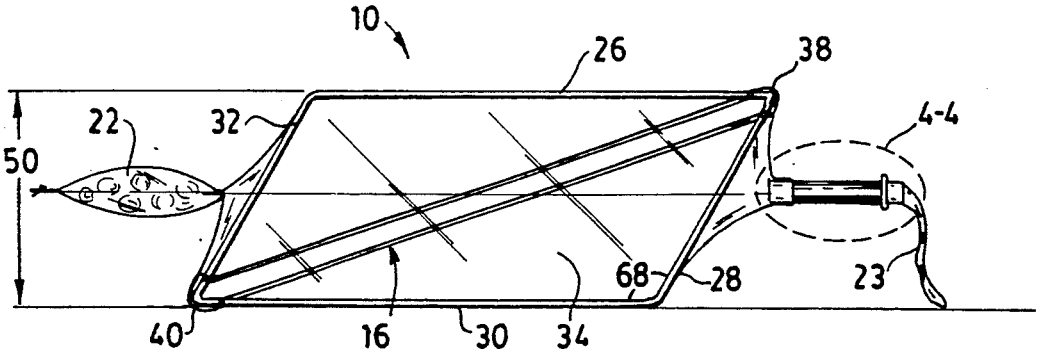
FIG. 2 is a side view of the embodiment of FIG. 1, showing said embodiment in its uncompressed form.

In the embodiment shown in FIGS. 1 and 2, semirigid member 14 is comprised of interior walls 26, 28, 30, and 32. These walls 26, 28, 30, and 32 define a parallelogram enclosing space 34. However, as the pump 10 is compressed (see FIG. 3), the shape of space 34 is changed as the positions of walls 26, 28, 30, and 32 change with regard to each other.

Figure 3:
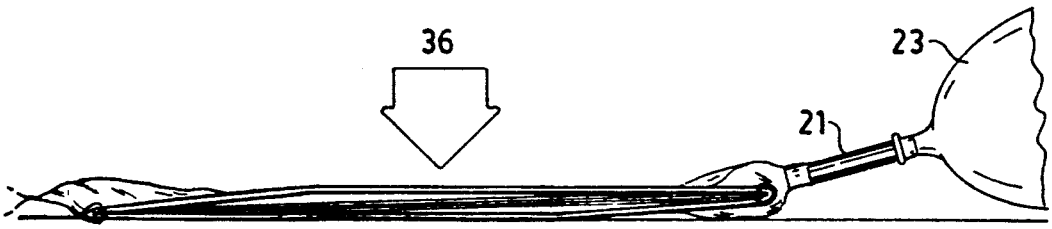
FIG. 3 is a side view of the embodiment of FIG. 1, showing said embodiment its compressed form.

Referring to FIG. 3, pump 10 may be compressed by the application of force in the direction of arrow 36 so that, in such compressed state, the volume of the chamber defined by semirigid member 14, is at a minimum. When the force 36 is removed, however, the pump 10 returns to its uncompressed state (see FIG. 2) because of the tension imparted by rubber band 16.

Referring to FIGS. 1 and 2, elastic means 16 may be attached to opposing corners 38 and 40 of semirigid member 14. As will be apparent to those skilled in the art, elastic means 16 may be an integral part of semirigid member 14. Thus, e.g., referring to FIGS. 10 through 21, semirigid member 14 may consist essentially of elastic material which will cause its opposing walls 80 and 82 to tend to maintain themselves in fixed spatial relationship to each other.

Referring again to FIG. 1, when the volume of the chamber defined by pump 10 is at a minimum, the width 42 of said semirigid member 14 is less than the width 44 of bag 12. It will be appreciated that, in the preferred embodiment illustrated in FIG. 1, the width 44 of closed compartment 22 is identical to the width 44 of bag 12, said bag 12 and closed compartment 44 being formed from the same container in this embodiment. In other embodiments, not shown, the width 44 of bag compartment 22 differs from the width of bag 12.

Figure 9:
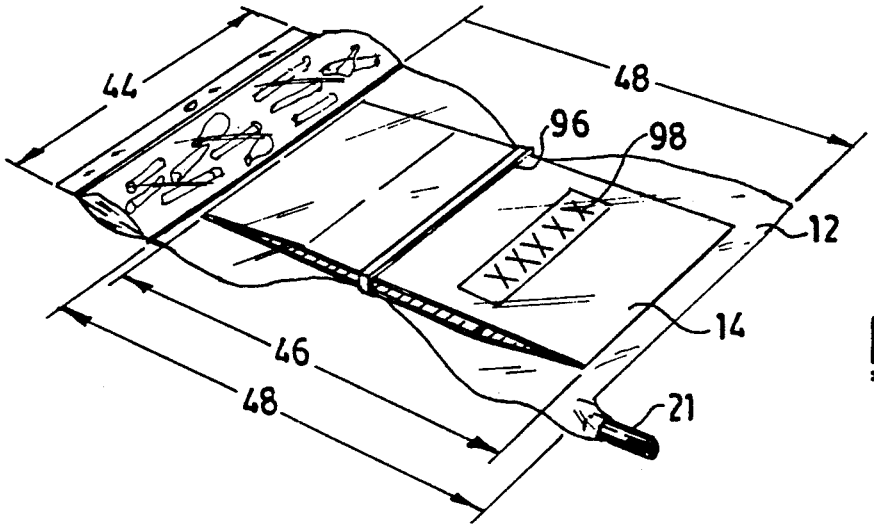
FIG. 9 is another perspective view of the pump assembly of FIG. 1, illustrating such pump assembly secured in a compressed state by a rubber band.

It will also be appreciated by those skilled in the art that, when the volume of the chamber defined by pump 10 is at a minimum, the length 46 of said semirigid member 14 is less than the length 48 of bag 12 (see FIG. 9).

Referring again to FIG. 2, when said pump 10 is uncompressed, the height 50 of the semirigid member 14 plus the width 42 will be either equal to or less than the width 44 of the bag 12 (also see FIG. 9).

Regardless of the configuration of semirigid member 14, it always will contain at least two walls which define a space between them. Thus, referring to FIG. 2, the walls 26, 28, 30, and 32 define a space 34 encompassed by a parallelogram. Thus, referring to FIG. 10, walls 80 and 82 define a space 84 which is encompassed by a truncate ovoidal shape 84.

Regardless of the shape defined by the opposing walls of semirigid member 14, it is essential that space enclosed by said shape be substantially empty. As used in this specification, the term substantially empty refers to a space in which less than about 10 percent by volume of such space is occupied by a solid material. Thus, referring to FIG. 2, only rubber band 16 occupies the space defined by walls 26, 28, 30, and 32. Thus, referring to FIG. 10, no solid material is disposed within the space defined by walls 80 and 82. This feature is essential in applicant's pump, for it insures an improved delivery air fluid from the pump.

In one preferred embodiment, illustrated in FIGS. 1 and 2, inner semirigid member 14 consists essentially of corrugated cardboard. As is known to those skilled in the art, cardboard is a variety of pasteboard and is a class of thick paper used chiefly for making boxes and cartons. See, e.g., page 584 of George S. Brady et al.'s "Materials Handbook," Twelfth Edition (McGraw Hill Book Company, New York, 1986). It is preferred that said cardboard be F-fluted cardboard which is from about 0.05 to about 0.08 inches thick.

In one preferred embodiment, illustrated in FIGS. 10, 11, 12, 13, and 14, inner semirigid member 14 consists essentially of "LEXAN" (a thermoplastic carbonate-linked polymer, produced by reacting bisphenol A and phosgene, and sold by the General Electric Company, polymers product Division, pittsfield, Ma. 01201).

Figure 3A:
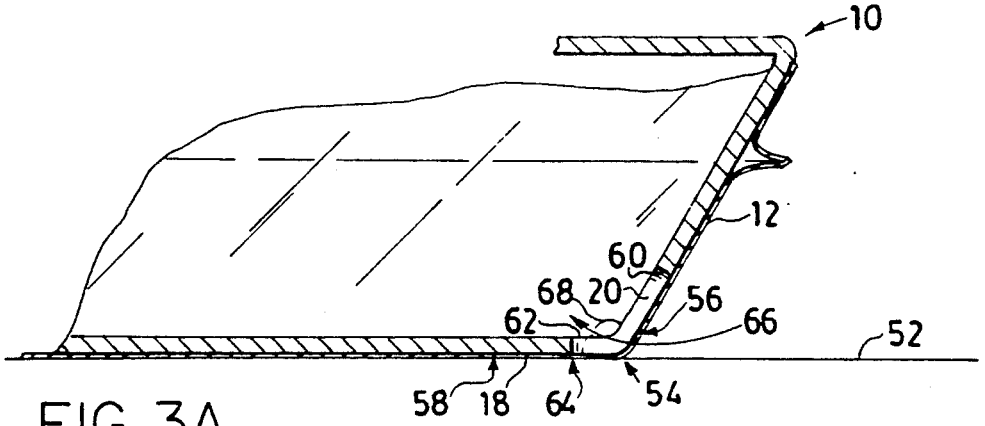
FIG. 3A is a partial sectional side view of the embodiment of FIG. 1, illustrating how the inner and outer intake orifices of said pump are aligned when the pump is not compressed.

FIG. 3A is a partial cross-sectional view of the embodiment of FIG. 1, illustrating the pump 10 prior to the time it is compressed. Referring to FIG. 3A, it will be seen that the pump 10 is resting upon a substantially flat, nonporous surface 52 The orifice 18 extending through bag 12 communicates with the orifice 20 extending through semirigid member 14, thereby forming fluid passageway 54. As will be seen by reference to FIG. 3A, orifice 18 extends from points 56 to 58, orifice 20 extends from points 60 to 62, and fluid passageway 54 (which is defined by the communication of orifices 18 and 20) extends from points 56 to 64. Thus, air may enter or exit said passageway in the direction of arrow 66.

It will be appreciated that orifice 18 and orifice 20 are not necessarily the same size and, furthermore, are not necessarily totally aligned with each other; however, in the embodiment of FIG. 3A, there is some degree of alignment so that passageway 54 exists. It will also be appreciated that, as pump 10 is compressed, the semirigid member 14 will change its configuration in a manner different than flexible bag 12.

Figure 3B:
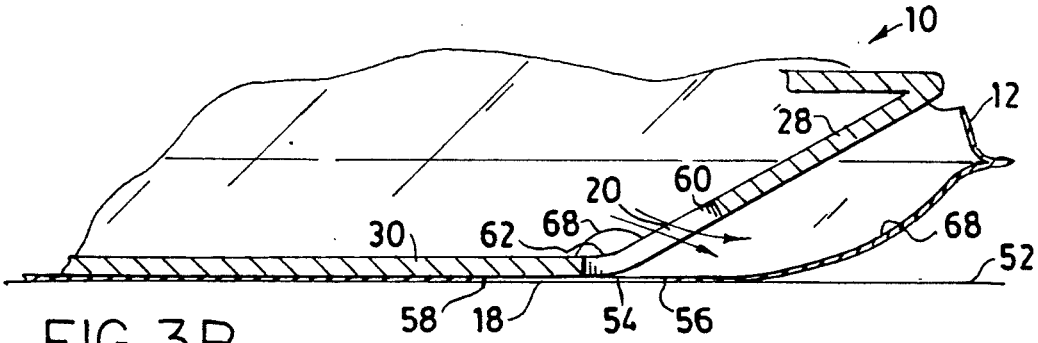
FIG. 3B is a partial sectional side view of the embodiment of FIG. 1, illustrating how the inner and outer intake orifices of said pump are aligned when the pump is under initial compression.

Thus, referring to FIG. 3B, as pump 10 is compressed, semirigid member retains a shape as a parallelogram but the angle 68 between sides 28 and 30 increases. However, bag 12, which is flexible and relatively unconstrained, tends to billow out because of the fluid flow which occurs.

Because members 12 and 14 change their configurations in different manners upon compression, the relative positions of orifices 18 and 20 change during compression. Referring to FIG. 3B, orifice 18 still extends from points 56 to 58, orifice 20 still extends from points 60 to 62, but the fluid passageway now extends from points 56 to 62. Air forced out through orifice 20 impinges against the inner surface 68 of bag 12, causing it to billow out and causing passageway 54 to be blocked by nonporous surface 52. When this occurs, air is thus forced out of check valve 21. Balloon 23 may be attached to the end of the check valve 21 and be inflated.

Figure 3C:
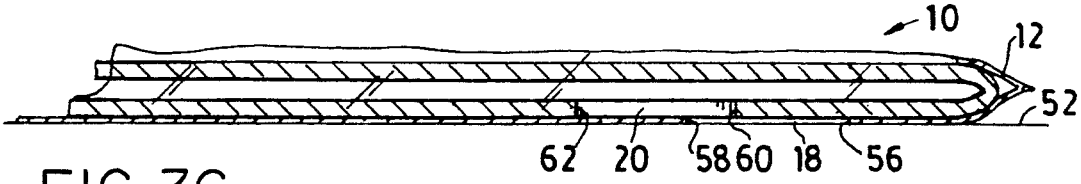
FIG. 3C is a partial sectional side view of the embodiment of FIG. 1, illustrating how the inner and outer intake orifices of said pump are aligned when the pump is fully compressed at the end of the pump stroke.
Figure 3D:
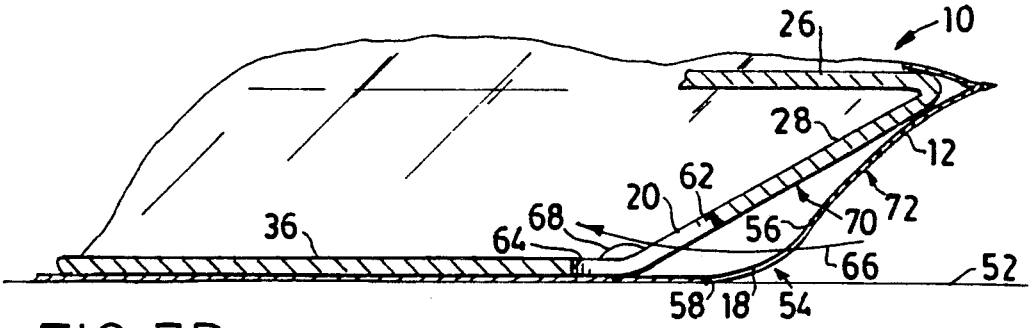
FIG. 3D is a partial sectional side view of the embodiment of FIG. 1, illustrating how the inner and outer intake orifices of said pump are aligned when the compressive force applied to said pump is released.

As the compression process is continued, air is continually forced out through the check valve until, as is shown in FIG. 3C, substantially all of the air which was within the pump has been discharged.

Once the compressive force on pump 10 is released, the resilient means 16 (not shown in FIGS. 3A-3D) tend to pull opposing walls 28 and 32 (not shown), and opposing walls 36 and 26, back into the parallelogram structure shown in FIG. 2. The angle 68 will decrease until it is equal to the angle 68 of the structure of FIGS. 2 and 3A. Because the pressure of the air (or other fluid) outside of pump 10 exceeds the pressure of the fluid within the pump chamber (defined by the walls of member 14), air tends to impinge upon the outer surface 72 of bag 12 and cause to approach the outer surface 70 of wall 28 until it is contiguous therewith. This air pressure differential tends to hold bag 12 against the outer surface of side 28 as the side 28 rises and changes its angle with respect to side 36. As this occurs, the common passageway 54 defined by orifices 18 and 20 increases as the degree of communication between said orifices increases.

Figure 4:
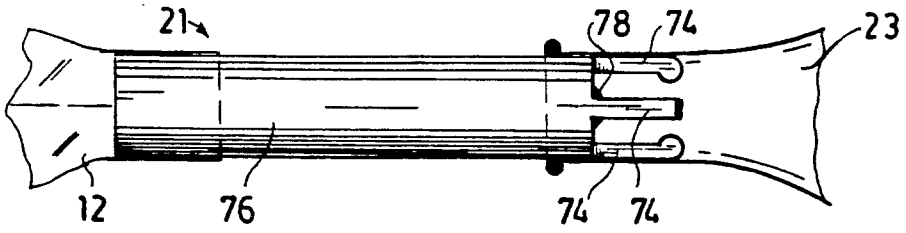
FIG. 4 is a side view of a one-way check valve used on the embodiment illustrated in FIG. 1.
Figure 5:
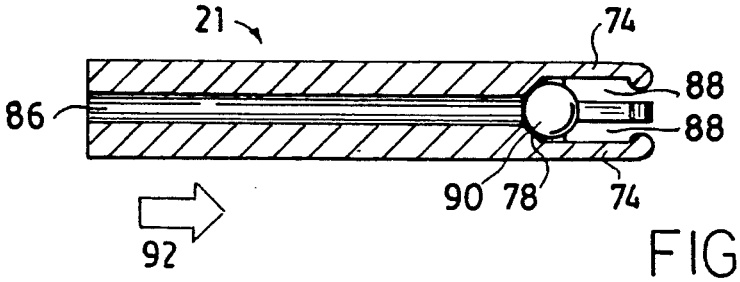
FIG. 5 a cutaway view of the valve of FIG. 4, taken along the centerline.

FIG. 4 is a side view of one preferred embodiment of the check valve 21 of FIG. 2. Referring to FIG. 4, check valve 21 is comprised of body 76 and fingers 74. One end of check valve 21 is secured to bag 12. A balloon 23 is shown attached to the other. FIG. 5 is a sectional side view of check valve 21 showing ball 78 being caged by fingers 74.

Check valve 21 is preferably constructed of an thermoplastic material. In one preferred embodiment, check valve 21 consists essentially of "DELRIN" (an acetal resin sold by the E.I. Du pont de Nemours and Company of Wilmington, Delaware. Alternatively, or additionally, one may use other thermoplastic material such as, e g. polystyrene, nylon, acrylonitrile-butadiene-styrene (ABS) polymers, and the like. These thermoplastic materials are described in the aforementioned "Materials Handbook," the disclosure of which is hereby incorporated by reference into this specification.

Referring to FIG. 5, check valve 21 is comprised of fluid passageway 86. When fluid flows in the direction of arrow 92. The ball travels inside the fingers in the direction of the arrow and allows the fluid to pass through slots 88 which are defined by fingers 74. However, when fluid attempts to flow in the other direction, the ball seats against wall 90 and prevents the flow of fluid in such direction.

Figure 6:
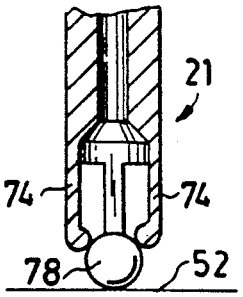
FIG. 6 is a sectional view of the tip of the valve of FIG. 4, prior to the insertion of a ball into said valve.
Figure 7:
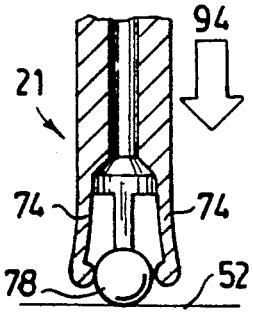
FIG. 7 is a sectional view of the tip of the valve of FIG. 4, showing the ball partially inserted into said valve.
Figure 8:
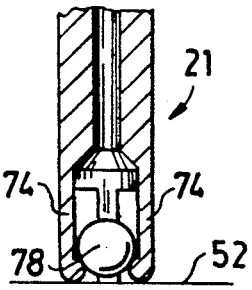
FIG. 8 is a sectional view of the tip of the valve of FIG. 4, showing the ball fully inserted into said valve.

A ball may be inserted into the cage of ball valve 21, as is shown in FIGS. 6, 7, and 8 This ball may be any suitable solid material. Thus, by way of illustration, it may be comprised of metal (such as a copper-clad BB), plastic (such as "DELRIN"), and the like.

In one preferred embodiment, check valve 21 has a substantially circular cross-section with an internal diameter of from about 0.18 inches to about 0.625 inches. In such embodiment, the ball 78 has a diameter of from about 0.17 to about 0.5 inches.

FIGS. 6, 7, and 8 illustrate one means of seating ball 78 within the cage of check valve 21. Referring to these Figures, it will be seen that ball 78 may be placed upon nonporous surface 52, the cage of check valve 21 may be disposed over said ball (see FIG. 6), force may be applied in downwardly in the direction of arrow 94 see FIG. 7), and the ball will thus be forced into the check valve cage (see FIG. 8).

FIG. 9 is a perspective view, taken from the top, of the pump 10 of FIG. 1, when said pump is in a compressed state and is maintained in said compressed state by rubber band 96. It should be noted that, in this compressed state, semirigid member 14 has both a width and a length which are smaller than the width and length of flexible bag 12.

The pump 10 of this invention is so adapted that printed material may appear on one or more exterior surfaces of member 14 and, since flexible bag 12 preferably consists essentially of transparent material, the printed matter will be displayed through said flexible bag 12; note the printed indicia 98.

Figure 10:
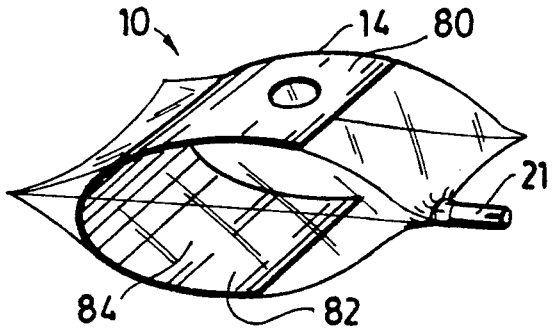
FIG. 10 is a perspective view of another embodiment of the low pressure pump of this invention.
Figure 11:
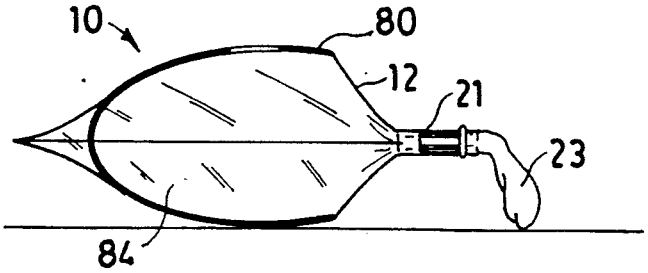
FIG. 11 is a side, sectional view of the pump of FIG. 10.
Figure 12:
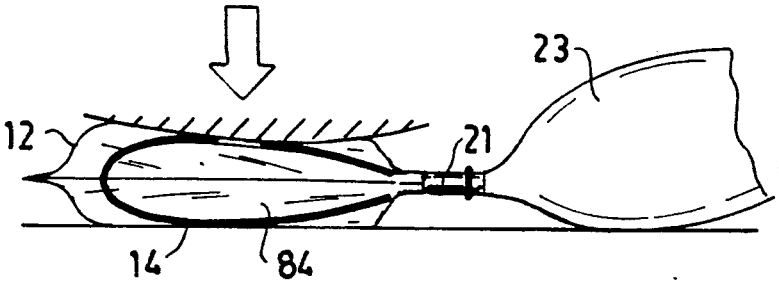
FIG. 12 is a side sectional view of the pump of FIG. 10, showing it partially compressed by a body part, which blocks an intake orifice.

FIGS. 10, 11, and 12 illustrate another preferred embodiment of applicant's invention. In this embodiment, the semirigid member 14 is preferably comprised of a one-piece thermoplastic material which inherently elastic. The pumps shown in FIGS. 10, 11, and 12 may be comprised of check valve 21. Alternatively, one or more of them may be comprised of hollow tubing. In the latter embodiment, as balloon 23 is being inflated, the operator may pinch balloon 23 with his fingers between pump strokes to insure that air does not flow out of the balloon.

Figure 13:
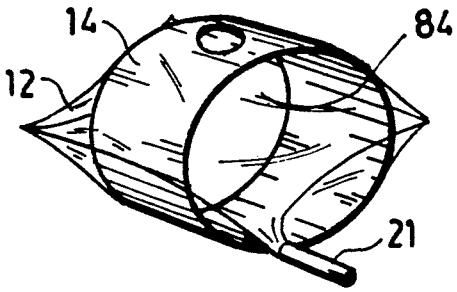
FIG. 13 is a perspective view of another embodiment of the low pressure pump of this invention.
Figure 14:
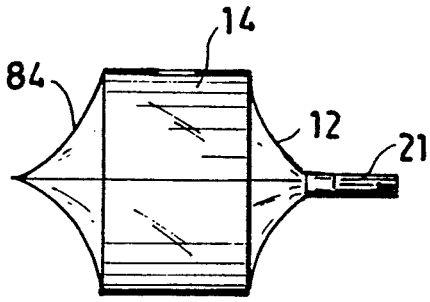
FIG. 14 is a side view of the embodiment of FIG. 13.

Another preferred embodiment of pump 10 is shown in FIGS. 13 and 14. In this embodiment, the semirigid member 14 has a substantially circular cross-section.

Figure 15A:
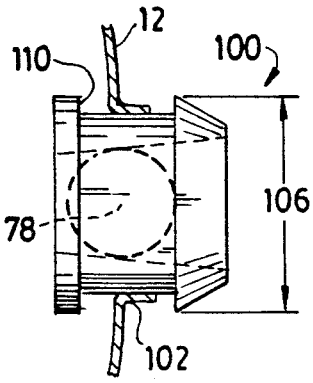
FIGS. 15A, 15B, and 15C illustrate one preferred means for attaching a check valve and output tubing to a preferred embodiment of the pump of this invention.
Figure 15B:
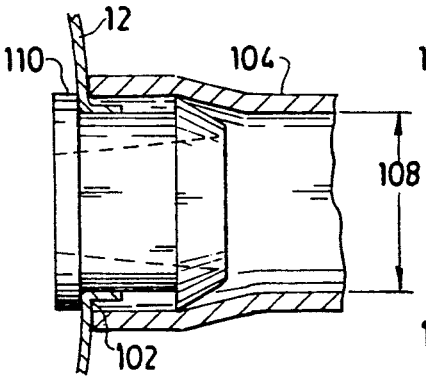
Figure 15C:
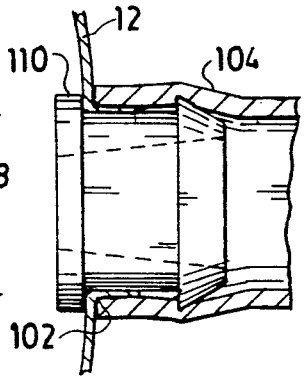
Figure 16:
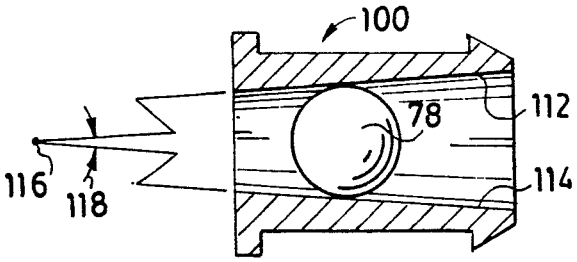
FIG. 16 is a partial sectional view of a preferred ball valve used in the pump of this invention.

FIG. 15A, 15B, and 15C illustrate a means of securing a check valve 21 assembly to flexible bag 12

Referring to FIG. 15A, valve body 100 is inserted through a hole in bag 12 (not shown) A corner of bag 12 may be cut so that it creates an orifice smaller than the outside diameter of valve body 100, and valve body 100 may then be pushed through said corner, thereby creating distended flare 102.

Once the valve body 100 has been pushed through the corner of the bag 12, vinyl tubing 104 having a smaller inside diameter 108 than the outside diameter 106 of the valve body 100 is forced onto the valve body 100, thereby impinging the bag 12 and the flare 102 and securing them to the valve body 100 (see FIGS. 15B and 15C).

In one preferred embodiment, the interior walls 112 and 114 are not parallel but, when extended to a point 116 of intersection, form an angle 118 of from about 7 to about 21 degrees.

Figure 17:
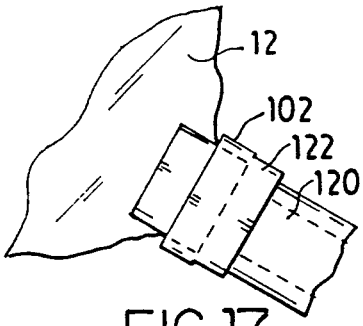
FIG. 17 is a partial view of a preferred embodiment of invention in which the pump does not contain a check valve.

In one embodiment, illustrated in FIG. 17, a corner of bag 12 may be cut in the manner described above and a hollow tube 120 may be forced through said orifice, creating a similar flare 102. Thereafter, tape 122 may be used to secure the flare 102 and bag 12 to the tubing 120.

Figure 18:
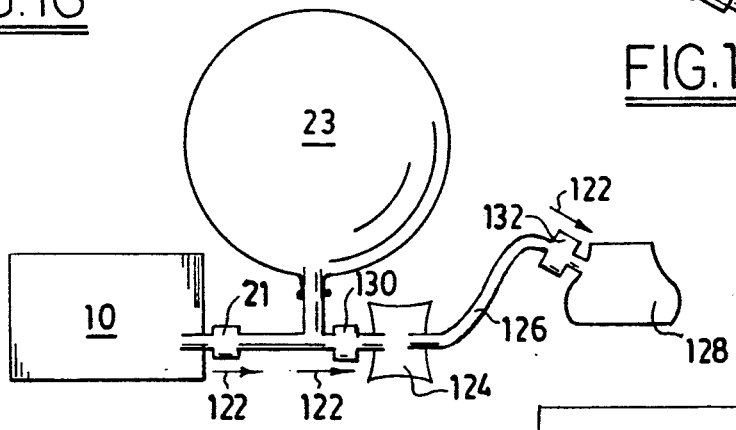
FIG. 18 is a schematic of a two-stage pump comprised of a pump comparable to the pump of FIG. 1.

FIG. 18 is a schematic representation of an apparatus which may be used to deliver both low and high pressure fluid to a receptacle. Referring to FIG. 18, low pressure fluid pump 10 is provided. As described above (see FIG. 2, e.g.), this pump 10 is equipped with a first check valve 21 which allows fluid to flow in the direction of arrow 122. The fluid is able to flow into receptacle 23, and also through check valve 130 into bag 124 similar to bag 12, and also through line 126 through check valve 132 into receptacle 128. It should be noted that bag 124 contains no internal structure which Would resist compression or reduce its effective volume.

Once the pressure of the fluid in receptacle 128 begins to exceed the pressure of the fluid in resilient receptacle 23, then the fluid will tend to inflate receptacle 23, it offering less resistance to inflation.

Once receptacle 23 has been partially of fully inflated, it will tend to discharge fluid in the direction of both check valve 21 and 130; however, air fluid will only be allowed to flow through check valve 130. Thus bag 124 will tend to stay fully inflated when it is not being compressed.

Thus, once the receptacle 23 has been partially or fully inflated, bag 124 may be compressed to deliver fluid to receptacle 128. Receptacle 23 acts as a reservoir for bag 124, furnishing it with fluid.

In the operation of the apparatus of FIG. 18, pump 10 is initially repeatedly compressed until as much fluid as possible fills both receptacle 128 and receptacle 23. Thereafter, bag 124 is repeatedly compressed to further fill receptacle 128, thereby transferring fluid from receptacle 23 to receptacle 128. The process may be repeated as often as necessary.

As will be apparent to those skilled in the art, the smaller the configuration of bag 124, the higher the pressure of the fluid delivered to receptacle 128. There will, however, be less volume delivered with each compression. Whichever receptacle offers the least resistance (such as a balloon 23), it will tend to be inflated prior to the other receptacle Thus, as receptacle 23 becomes inflated, it acts as an air reservoir.

Figure 19:
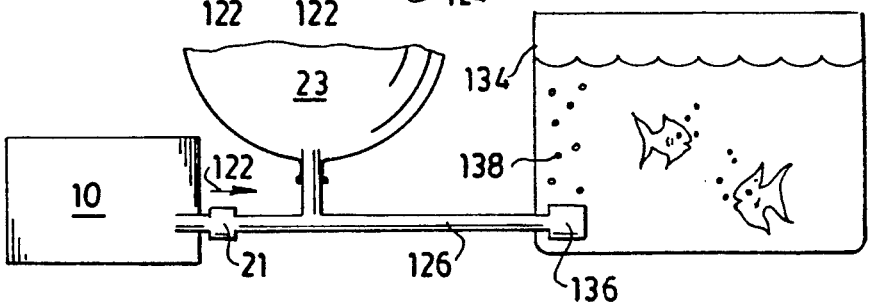
FIG. 19 illustrates an apparatus comprised of the pump of this invention being used to aerate a minow bucket.

An apparatus similar to that illustrated in FIG. 18 is shown in FIG. 19. This apparatus may be used to aerate a fluid receptacle comprised of fish such as, e.g., a minnow bucket 134. In the apparatus of FIG. 19, pump 10 pushes fluid through check valve 21. Air passing through check valve 21 is free to flow into receptacle 23 and into air stone 136; as is known to those skilled in the art, air flowing into air stone 135 causes air to slowly escape from such air stone, thereby forming bubbles 138.

The air stone 136 allows only a small volume of air to pass through, and air may pass freely into and out of balloon 23. Because of the resistance to a large volume of air flow in air stone 136, receptacle 23 will tend to be inflated when pump 10 is compressed. Once receptacle 23 is partially or fully inflated, it acts as a rerservoir, causing air to escape from air stone 136 for a relatively long period of time.

Figure 20:
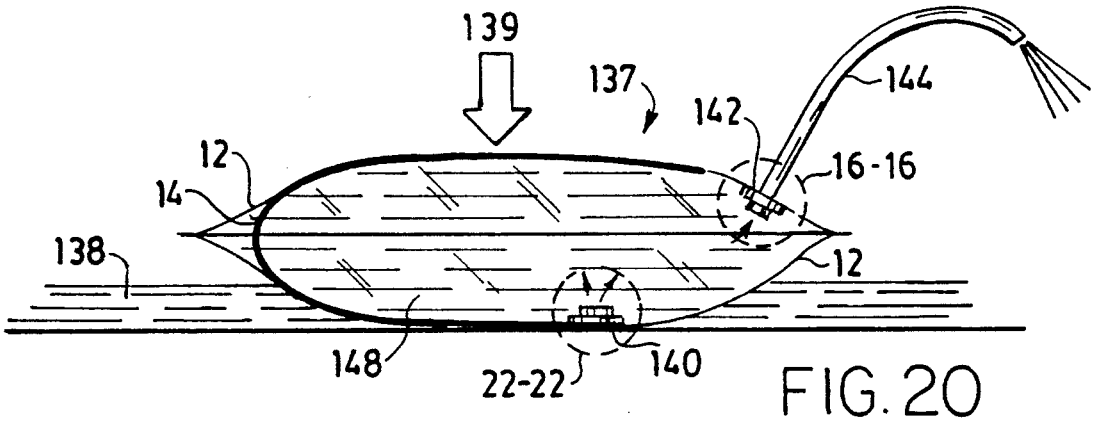
FIG. 20 is a side view of another preferred embodiment of the invention.

FIG. 20 illustrates a baling pump 137 which may be used to pump liquid 138; when compressive force is applied to this pump in the direction of arrow 139 (see FIG. 20), water is forced out of pump 137. This pump 137 is equipped with a intake valve 140, a check valve 142, tubing 144, flexible bag 12, and semirigid member 14.

Figure 21:
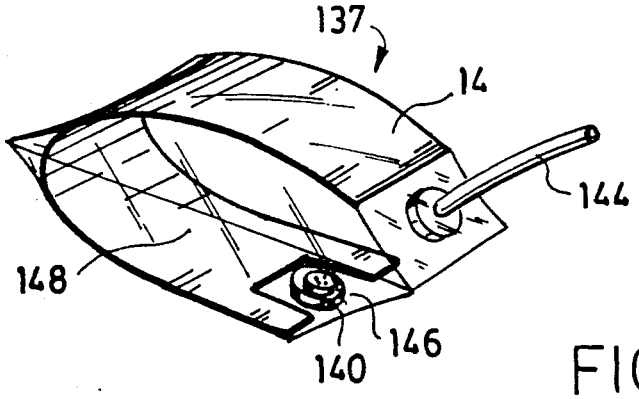
FIG. 21 is a perspective view of the embodiment of FIG. 20.

As is shown in FIG. 21, it is preferred that semirigid member be an integral assembly extending substantially the entire length of pump 10. However, it is also preferred that the bottom surface of member 14 contain a cutout portion 146 to allow valve 140 to extend into the chamber 148 of the pump 10.

Figure 22:
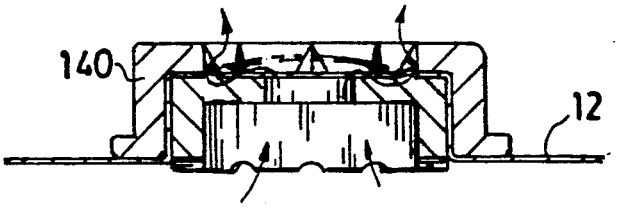
FIG. 22 is a sectional view of the inlet of FIG. 20.

FIG. 22 illustrates a typical intake flap valve 140 which may be used in the pump assembly and extend into chamber In the operation of pump 137, when the pump is compressed, flap valve 140 closes, and water is forced out of check valve 142 and through tubing 144 When the compressive force is released upon pump 137, flap valve 140 opens, and fluid is drawn into the chamber 148 of pump 137.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

I claim:

1. A low pressure fluid pump, including:

a flexible envelope having top and bottom faces defining a pump chamber therebetween;

an articulate frame disposed within said envelope and responsive to external pressure applied to said envelope to move from an expanded configuration and a maximum volume of said pump chamber, to a collapsed configuration and a minimum volume of said pump chamber; and elastic means to return said frame to said expanded configuration;

said envelope defining an intake aperture in the bottom face thereof;

said envelope, in cooperation with a smooth supporting surface, effective to seal said aperture when pressure is applied to the top of said envelope, and to unseal said aperture to admit fluid into said chamber when said pressure is removed.

2. A low pressure fluid pump as defined in claim 1, wherein said frame is a four link mechanism of a parallelogram of four walls, including top, bottom, and end walls.

3. A low pressure fluid pump as defined in claim 2, wherein one of said walls defines a frame aperture in communication with said intake aperture in said envelope.

4. A low pressure fluid pump as defined in claim 1, wherein said chamber is empty of structure other than said frame and said elastic means.

5. A low pressure fluid pump as defined in claim 1, wherein said envelope is longer than said frame when said frame is in said collapsed configuration.

6. A low pressure fluid pump assembly, comprising:

(a) an envelope of pliable sheet material including at least one orifice; (b) a flexible inner housing disposed within said envelope, wherein said envelope and said inner housing define a chamber which is variable in volume by flexing said envelope and said inner housing, and wherein said chamber at the maximum volume thereof includes no more than 10 percent by volume of solid material;

(c) elastic means for changing the shape of said inner housing and returning the configuration of said chamber to said maximum volume after said chamber been compressed to a configuration corresponding to less than said maximum volume;

(d) means for sealing said orifice when said pump assembly is placed against a flat, smooth surface and compressed; and (e) further including means for maintaining said pump in a configuration wherein said chamber is at its minimum volume.

7. A low pressure fluid pump assembly, comprising:

(a) an envelope of pliable sheet material including at least one orifice;

(b) a flexible inner housing disposed within said envelope, wherein said envelope and said inner housing define a chamber which is variable in volume by flexing said envelope and said inner housing, and wherein said chamber at the maximum volume thereof includes no more than 10 percent by volume of solid material;

(c) elastic means for changing the shape of said inner housing and returning the configuration of said chamber to said maximum volume after said chamber been compressed to a configuration corresponding to less than said maximum volume, said elastic means being a rubber band; and (d) means for sealing said orifice when said pump assembly is placed against a flat, smooth and compressed.

8. A fluid pumping device including:

a fluid line having an inlet end adapted for connection to a fluid source, and a discharge end adapted for connection to a fluid receptacle;

a limp formless inelastic bag operatively connected to said fluid line between said inlet end and said discharge end;

a first check valve between said inlet end and said bag, and a second check valve between said bag and said discharge end, both said valves permitting fluid flow in the direction from said source toward said receptacle and preventing fluid flow in the reverse direction;

said bag adapted to receive fluid from said source, and responsive to external pressure applied to said bag to discharge pressurized fluid into said receptacle.

9. A fluid pumping device as defined in claim 8 in which said fluid source is an air pump.

10. A fluid pumping device as defined in claim 8, further including an elastic reservoir between said first check valve and said bag, and a third check valve between said reservoir and said bag.

11. A fluid pump device as defined in claim 10 further including an air stone at said discharge end of said fluid line.

* * * * *